US010167136B2

(12) United States Patent
Steinke

(10) Patent No.: US 10,167,136 B2
(45) Date of Patent: Jan. 1, 2019

(54) FLUID STORAGE TANK

(71) Applicant: Daniel Steinke, Sexsmith (CA)

(72) Inventor: Daniel Steinke, Sexsmith (CA)

(73) Assignee: FracStac Energy Solutions Ltd., Alberta (CA)

( * ) Notice: Subject to any disclaimer, the term of this patent is extended or adjusted under 35 U.S.C. 154(b) by 27 days.

(21) Appl. No.: 15/285,340

(22) Filed: Oct. 4, 2016

(65) Prior Publication Data

US 2017/0101260 A1 Apr. 13, 2017

Related U.S. Application Data

(60) Provisional application No. 62/238,480, filed on Oct. 7, 2015.

(51) Int. Cl.

| | |
|---|---|
| ***B65D 88/02*** | (2006.01) |
| ***B65D 81/38*** | (2006.01) |
| ***B65D 88/74*** | (2006.01) |
| ***B65D 90/12*** | (2006.01) |
| ***E21B 43/26*** | (2006.01) |
| ***B65D 90/16*** | (2006.01) |

(52) U.S. Cl.

CPC ..... *B65D 88/022* (2013.01); *B65D 81/3813* (2013.01); *B65D 88/027* (2013.01); *B65D 88/744* (2013.01); *B65D 88/748* (2013.01); *B65D 90/12* (2013.01); *B65D 90/16* (2013.01); *E21B 43/26* (2013.01); *B65D 2519/0096* (2013.01); *B65D 2519/0097* (2013.01); *B65D 2519/00955* (2013.01); *B65D 2519/00975* (2013.01); *B65D 2590/0091* (2013.01); *Y10T 137/8622* (2015.04)

(58) Field of Classification Search

CPC ..... B65D 88/022; B65D 2519/00955; B65D 2519/0096; B65D 2519/0097; B65D 2519/00975; B65D 88/748; B65D 81/3813; Y10T 137/8622

See application file for complete search history.

(56) References Cited

U.S. PATENT DOCUMENTS

| | | | | |
|---|---|---|---|---|
| 4,924,897 | A * | 5/1990 | Brown | B65D 90/34 137/1 |
| 6,017,064 | A * | 1/2000 | Harrington | F16L 41/08 285/114 |
| 9,555,734 | B2 * | 1/2017 | Hamm | B60P 3/2215 |
| 2010/0025407 | A1 * | 2/2010 | Benson | B65D 88/022 220/564 |
| 2010/0032435 | A1 * | 2/2010 | Satterfield | B60P 3/221 220/562 |
| 2012/0138630 | A1 * | 6/2012 | Kinsey, III | B65D 88/748 222/1 |
| 2015/0008218 | A1 * | 1/2015 | Lupul | B65D 88/005 220/8 |
| 2015/0060369 | A1 * | 3/2015 | Richie | C02F 1/5281 210/723 |

(Continued)

*Primary Examiner* — Atif Chaudry

(74) *Attorney, Agent, or Firm* — Oyen Wiggs Green & Mutala LLP

(57) ABSTRACT

Stackable frac tanks for storing fluid which include a first tank and a second tank stackable atop of the first tank. A fluid connection device is affixed to the first and second tanks to fluidly connect the first and second tanks together. The stackable frac tanks may include a structural support frame interposed between the first and second tanks.

18 Claims, 6 Drawing Sheets

(56) References Cited

U.S. PATENT DOCUMENTS

| | | | | |
|---|---|---|---|---|
| 2015/0284194 | A1* | 10/2015 | Oren | B65D 88/30<br>414/373 |
| 2016/0237789 | A1* | 8/2016 | Hoffman | E21B 43/26 |
| 2016/0362307 | A1* | 12/2016 | Shiner | B01D 1/0082 |

* cited by examiner

FLUID STORAGE TANK

FIELD OF THE INVENTION

Frac Tanks or buffer tanks are used when oil and gas exploration companies have completed the drilling cycle and want to bring the well on production. To complete this process a special service rig or drilling rig is used depending on the depth. To set up the lease many different pieces of equipment and volumes of water or fluid is brought on site. To help free up space, a large stacking tank system is engineered to hold a large volume of fluid approximately 500/m3 per system including both a master and a slave tank on top.

BACKGROUND OF THE INVENTION

In the development of long horizontal drilling, changes in the fracking processes has seen the use of small volumes of oil with very large volumes of water. In today's drilling industry horizontal wells use anywhere between 3000/m3 of fluid to 60,000/m3 in the well bore fracking process and in multi stages. This volume requires a large footprint of storage on the lease site, the need for a new dual system would replace approximately 9.5 conventional 400 bbl tanks on a customer's location.

Today, fracking occurs continuously for hours. With this strenuous production the requirement of extra frack equipment on hand is needed in case of breakdowns; this is very important for a smooth and successful outcome.

Current wells are drilled for many meters horizontally and have up to 20 or more frack stages in the same well bore. This is why the need for an appropriate amount of tanks and storage of fluids is important for completion on time and on budget. As is the norm in today's fracking market, time to set up, store and take down are key to a customer's cost control.

Objects of the invention will be apparent from the description that follows.

SUMMARY OF THE INVENTION

The invention consists of a pair of stackable frac tanks for storing fluid. A first tank is positioned on the ground in a desired location and a second tank placed on top of it and connected thereto. The tanks are in fluid communication with one another There is provided stackable frac tanks which include a first tank and a second tank stackable atop of the first tank. A fluid connection device is affixed to the first and second tanks to fluidly connect the first and second tanks together. The stackable frac tanks may include a structural support frame interposed between the first and second tanks.

The fluid connection device may include piping. The piping may include a lower elbow connectable to the lower tank and an upper elbow connectable to the upper tank. A floating flange may be connected between the lower and upper elbows. The piping may be four 180 degree bends.

The first tank may include a floor sloped from one end to another and it may include an internal manifold valve bank situated on the first tank's floor's lower end. It may also include an internal heat coil. Additionally, the first tank may include a folding catwalk.

The second tank may include a floor sloped from a center of the floor to the floor's opposed ends. It may also include a manual float level gauge.

Each of the first and second tanks may also include an electronic level gauge float post.

The foregoing was intended as a broad summary only and of only some of the aspects of the invention. It was not intended to define the limits or requirements of the invention. Other aspects of the invention will be appreciated by reference to the detailed description below.

BRIEF DESCRIPTION OF THE DRAWINGS

These and other features of the invention will become more apparent from the following description in which reference is made to the appended drawings and wherein.

DESCRIPTION OF THE PREFERRED EMBODIMENTS

Figure 1:
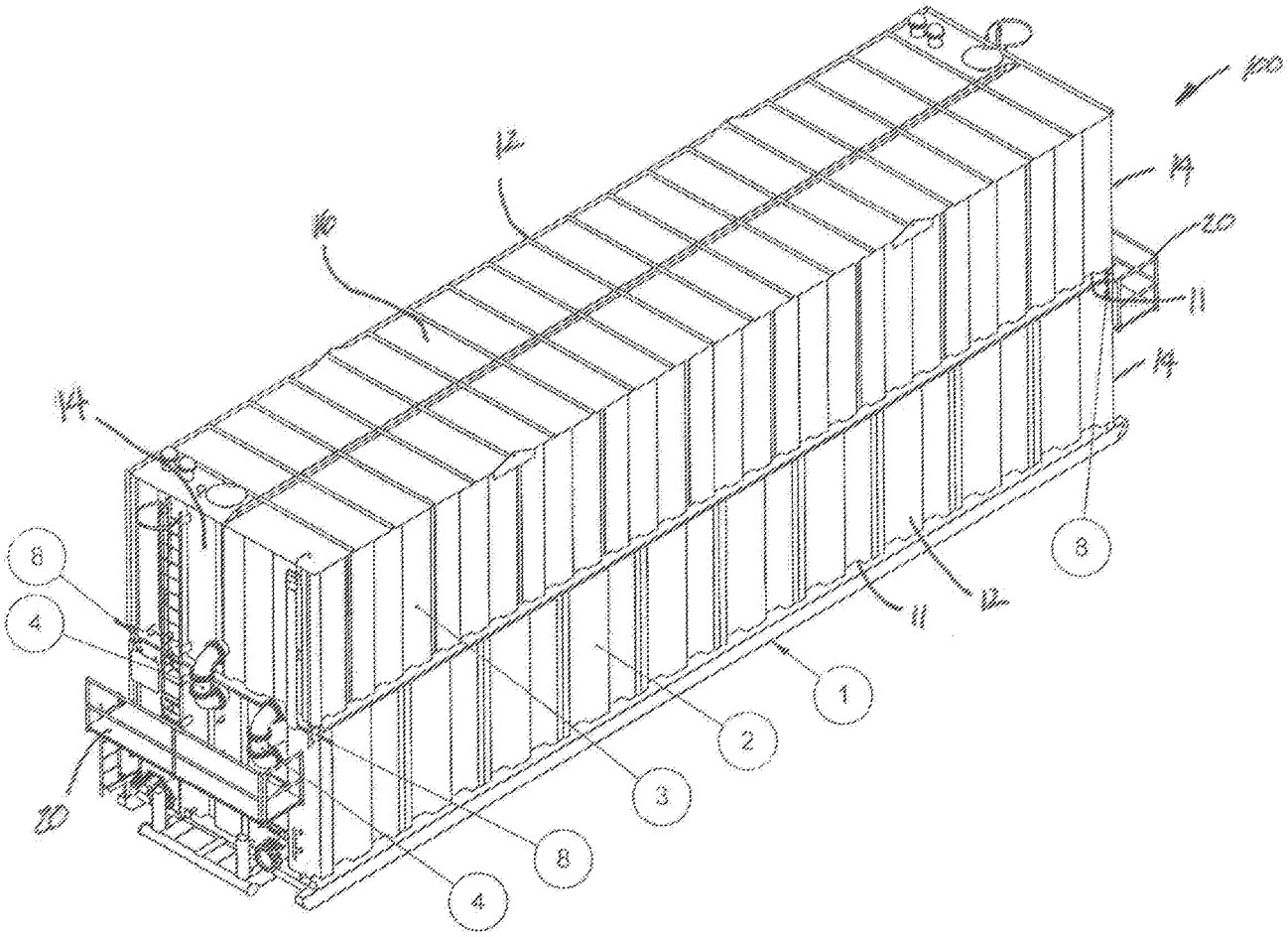
FIG. 1 is a perspective view showing a pair of stacked frac tanks according to the invention.

The preferred embodiment of a pair of stackable frac tanks 100 is shown in FIG. 1. Each tank is insulated and has a floor 11, two opposed sides 12, two opposed ends 14, and a roof 16. Floor 10, opposed sides 12, opposed ends 14 and roof 16 are constructed from corrugated steel. A lower tank 2 has deeper corrugations and is made from ¼" steel to support an upper tank 3. Upper tank 3 is made from 3⁄16" steel to minimize weight. For insulation, two inches of polystyrene insulation is glued to a substrate and clad with a pre-painted 22 gauge metal. The metal is also glued to the styrene. The stacking of two frac tanks (lower tank 2 and upper tank 3) allows for a reduced footprint on location and maximizes the amount of storage that can be hauled on a truck.

Figure 2:
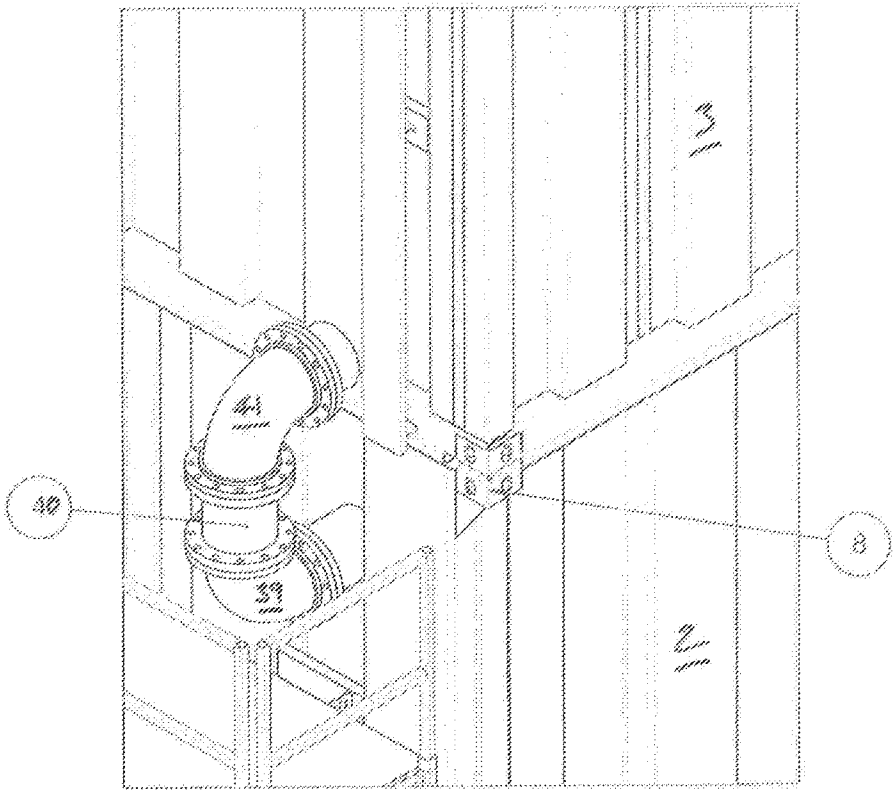
FIG. 2 is a perspective view of a portion the pair of stacked frac tanks shown in FIG. 1.
Figure 4:
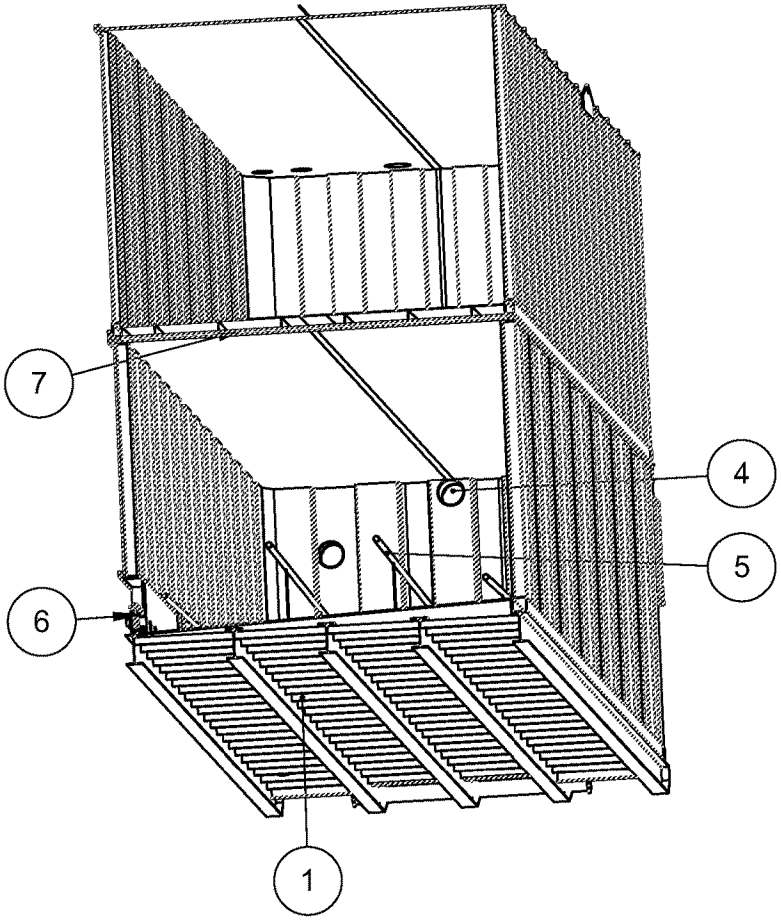
FIG. 4 is a perspective view from the end, showing the interior of the pair of stacked frac tanks of FIG. 1.

The invention comprises a lower tank 2 and an upper tank 3. Lower tank 2 with lower tank skid 1 is transported to a desired location by a truck and placed in position by way of a crane. A hollow structural section support frame 7, is placed over lower tank 2, as best depicted in FIG. 4. Upper tank 3 is hauled to site on removable skid 1 and stacked onto the lower tank 2 using a crane. Once properly positioned relative to one another, upper tank 3 is structurally connected to lower tank 2, preferably by way of standard ISO intermodal locking blocks 8 located in all corners, as best shown in FIG. 2.

Once structurally connected, the upper tank 3 and lower tank 2 are fluidly connected by way of piping 4, which are preferably in the form of 4-10 inch 180 degree bends (two at each end). At each end, one of the bends is set higher to allow for venting of the lower tank 2, and the other is set lower to allow draining of the upper tank 3. Piping 4 includes a lower elbow 39 connected to the lower tank 2 and an upper elbow 41 connected to the upper tank 3. In between the elbows resides a flexible floating flange 40 to allow for play between the lower 39 and upper 41 elbows. The play is necessary as exact alignment of the lower 39 and upper 41 elbows may not easily be achieved in the field. Preferably, to allow for ease of installation, the flange 40 is gasketless.

Figure 3:
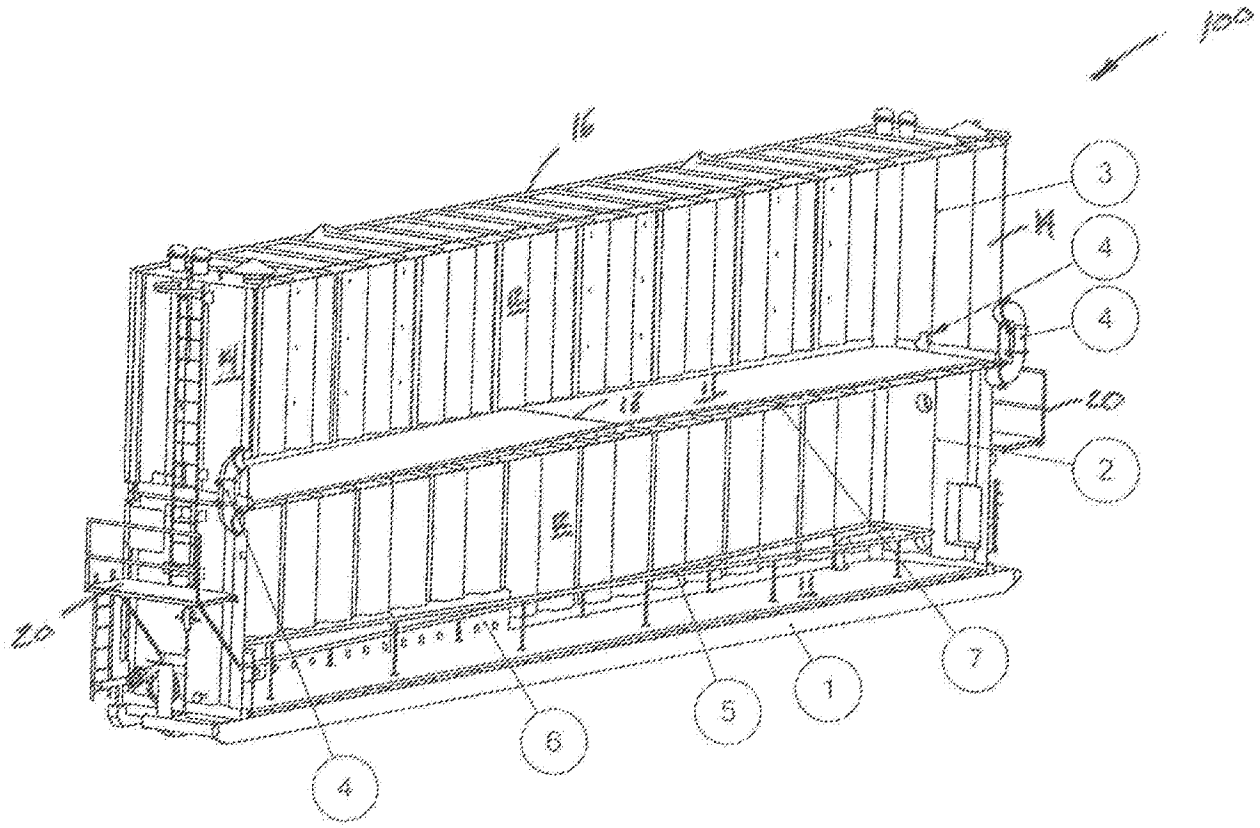
FIG. 3 is a perspective sectional view showing the interior of the pair of stacked frac tanks shown in FIG. 1.

As best depicted in FIG. 3, the floor 11 of the upper tank 3 is preferably sloped from the center 18 down to its opposed ends 14. The floor 11 of the lower tank 2 is sloped towards the manifold valve bank side 6. Advantageously, the manifold bank 6 allows for a plurality of connections to the lower tank 2. Preferably, the lower tank 2 is equipped with a heat coil 5 in the interior as shown in FIGS. 3 and 4. Heat coil 5 is used to regulate the temperature of the fluid in the stackable frac tanks 100. As mentioned previously, both tanks are insulated. Preferably there is no insulation on the roof 16 of the lower tank 2 or on the floor 11 of the upper tank 3 so that heat from the lower tank can migrate from it to the upper tank.

Figure 5:
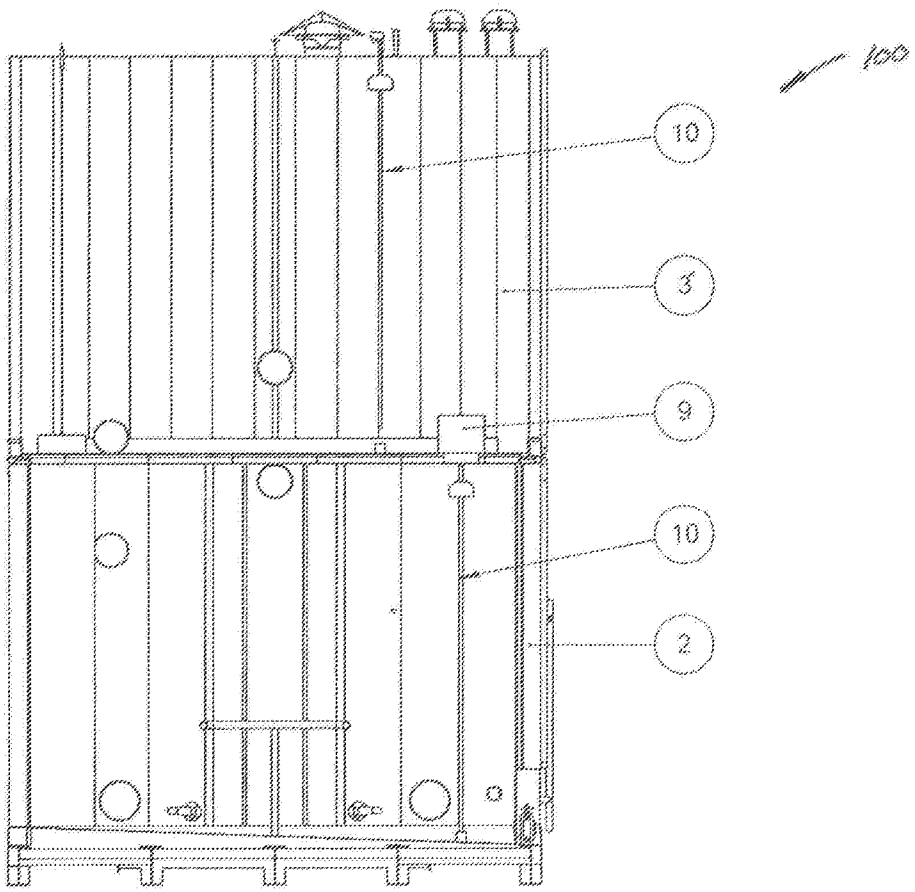
FIG. 5 is an end view of a pair of stacked frac tanks with the fluid connections removed.
Figure 6:
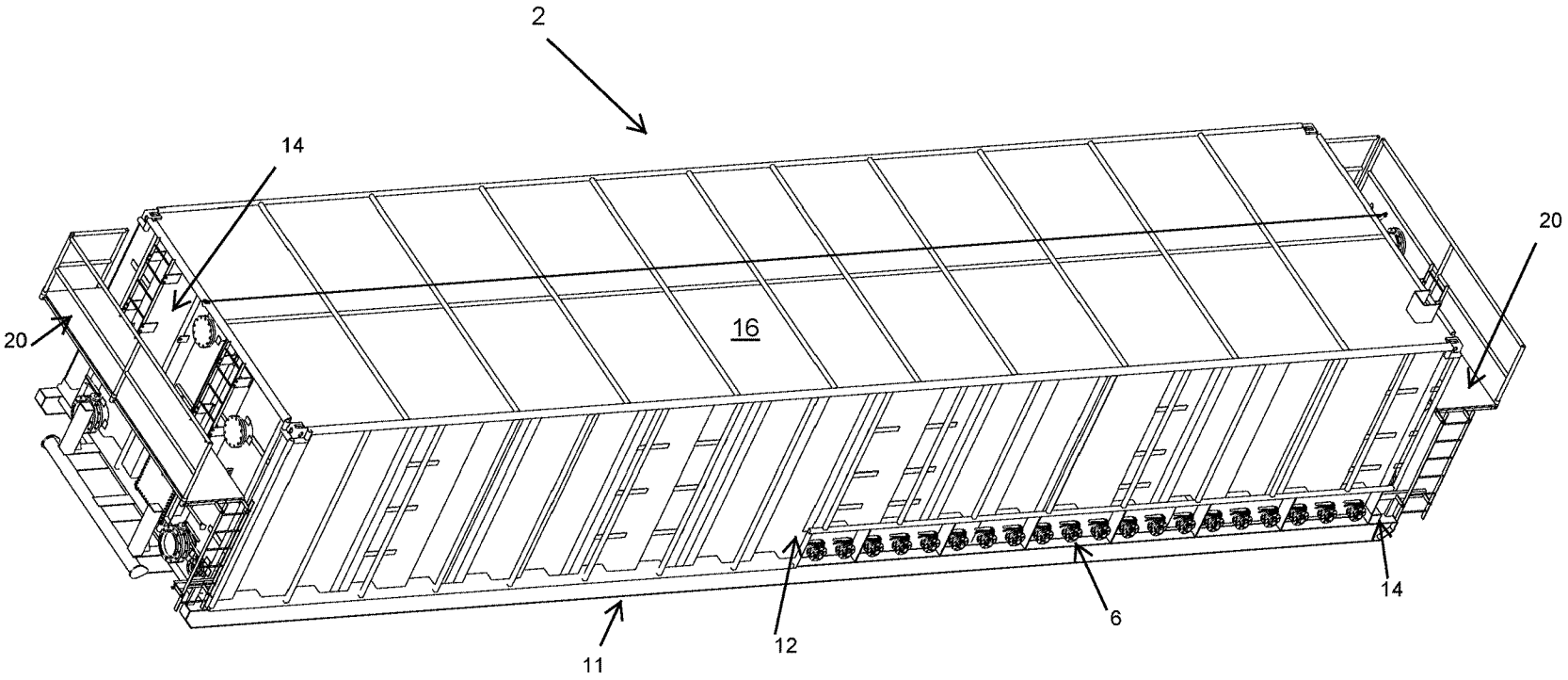
FIG. 6 is a perspective view from the opposite side of FIG. 1

Referring to FIG. 5, to monitor the fluid levels in the tanks, the upper tank 3 is equipped with a manual float level gauge system 10. Both the lower tank 2 and the upper tank 3 are equipped with an electronic level gauging system 10, preferably an electronic level gauge float post. A cavity 9 in the bottom of the upper tank 3 provides space to accommodate the electronic gauging head on the lower tank 2 when that tank is full. While in use, when the lower tank 2 becomes full, fluid is then pumped into upper tank 3.

The lower tank 2 can be equipped with a folding catwalk 20 at each end to allow access to the connections between the tanks.

It will be appreciated by those skilled in the art that the preferred and alternative embodiments have been described in some detail but that certain modifications may be practiced without departing from the principles of the invention.

What is claimed is:

1. A fluid storage tank for use in fracking operations comprising:

a first tank having first and second ends;

a second tank stackable atop of the first tank, the second tank having corresponding first and second ends;

the first end of the first tank being connectable in fluid communication with the first end of the second tank via at least two pieces of piping, a first one of the at least two pieces of piping being connectable at a first elevation on the first tank and at a first elevation on the second tank, a second one of the at least two pieces of piping being connectable on the first tank at a second elevation on the first tank that is higher than the first elevation on the first tank and at a second elevation on the second tank that is higher than the first elevation on the second tank;

wherein each one of the first and second tanks is insulated, except that no insulation is provided on a roof of the first tank or on a floor of the second tank.

2. The fluid storage tank of claim 1 further comprising a structural support frame interposed between said first and second tanks.

3. The fluid storage tank of claim 1 wherein each one of said at least two pieces of piping comprises a lower elbow connectable to said first tank and an upper elbow connectable to said second tank.

4. The fluid storage tank of claim 3 further comprising a floating flange connected between said lower and said upper elbows.

5. The fluid storage tank of claim 1 wherein said piping comprises four 180 degree bends.

6. The fluid storage tank of claim 1 wherein said first tank comprises a floor sloped from one end to another.

7. The fluid storage tank of claim 6 wherein said first tank further comprises an internal manifold valve bank situated on said first tank floor's lower end.

8. The fluid storage tank of claim 1 wherein said second tank comprises a floor sloped from a center of said floor to said floor's opposed ends.

9. The fluid storage tank of claim 1 wherein said first tank further comprises an internal heat coil.

10. The fluid storage tank of claim 1 wherein said second tank further comprises a manual float level gauge.

11. The fluid storage tank of claim 1 wherein each of said first and second tanks further comprise an electronic level gauge float post.

12. A fluid storage tank as defined in claim 1, wherein the second end of the first tank is connectable in fluid communication with the second end of the second tank via at least two further pieces of piping, a first one of the at least two further pieces of piping being connectable at a first elevation on the first tank and at a first elevation on the second tank, a second one of the at least two further pieces of piping being connectable on the first tank at a second elevation on the first tank that is higher than the first elevation on the first tank and at a second elevation on the second tank that is higher than the first elevation on the second tank.

13. A fluid storage tank as defined in claim 1, wherein the first tank has deeper corrugations and is made from a thicker steel than the second tank.

14. A fluid storage tank as defined in claim 13, wherein the first tank comprises ¼" steel, and wherein the second tank comprises 3/16" steel.

15. A fluid storage tank for use in oilfield operations comprising:

a first tank;

a second tank positioned above the first tank;

the first and second tanks being in fluid communication with one another at a first one of their respective ends via at least two pieces of pipe, a first one of the at least two pieces of pipe being positioned higher on both the first and second tanks than a second one of the at least two pieces of pipe to allow for venting of the lower tank; wherein the first and second tanks are in fluid communication with one another at a second one of their respective ends via at least two further pieces of pipe, a first one of the at least two further pieces of pipe being positioned higher on both the first and second tanks than a second one of the at least two further pieces of pipe to allow for venting of the lower tank.

16. A fluid storage tank as defined in claim 15, wherein the first tank has deeper corrugations and is made from a thicker steel than the second tank.

17. A method of using a fluid storage tank in a fracking operation, the method comprising the steps of:

providing a first tank and a second tank positioned above the first tank, the first and second tanks being in fluid communication with one another at a first one of their respective ends via at least two pieces of pipe, an upper one of the at least two pieces of pipe being positioned higher on both the first and second tanks than a lower one of the at least two pieces of pipe;

filling the first tank with fluid; and as the first tank becomes full, allowing air to vent through the upper one of the at least two pieces of pipe.

18. A method as defined in claim 17, wherein:

the step of providing a first tank and a second tank positioned above the first tank further comprises the first and second tanks being in fluid communication with one another at a second one of their respective ends via at least two further pieces of pipe, an upper one of the at least two further pieces of pipe being positioned higher on both the first and second tanks than a lower one of the at least two further pieces of pipe; and the step of allowing air to vent through the upper one of the at least two pieces of pipe further comprises allowing air to vent through the upper one of the at least two further pieces of pipe.

* * * * *